US008361407B2

(12) United States Patent
Cruickshank et al.

(10) Patent No.: US 8,361,407 B2
(45) Date of Patent: Jan. 29, 2013

(54) OVERHUNG AXIAL FLOW COMPRESSOR, REACTOR AND METHOD

(75) Inventors: Joseph Cruickshank, Menasha, WI (US); Massimo Camatti, Casalguidi-Pistoia (IT); Ronald John DeGroot, Appleton, WI (US)

(73) Assignee: Nuovo Pignone S.p.A., Florence (IT)

( * ) Notice: Subject to any disclaimer, the term of this patent is extended or adjusted under 35 U.S.C. 154(b) by 86 days.

(21) Appl. No.: 12/888,906

(22) Filed: Sep. 23, 2010

(65) Prior Publication Data

US 2011/0076201 A1 Mar. 31, 2011

(30) Foreign Application Priority Data

Sep. 30, 2009 (IT) ..... CO2009A0037

(51) Int. Cl.

| | |
|---|---|
| ***B01J 3/00*** | (2006.01) |
| *B01J 19/00* | (2006.01) |
| *F25B 9/00* | (2006.01) |
| *F25B 1/06* | (2006.01) |
| *F25B 31/00* | (2006.01) |
| *F25J 1/00* | (2006.01) |
| *B23P 15/00* | (2006.01) |

(52) U.S. Cl. ..... 422/242; 422/129; 422/198; 29/888.02; 62/6; 62/115; 62/116; 62/117; 62/191; 62/192; 62/193; 62/600; 62/611; 62/613

(58) Field of Classification Search ..... 422/129, 422/131, 242, 198; 29/888.02; 62/6, 115–117, 62/190–193, 196.1–196.3, 600, 606, 611, 62/613, 617–619

See application file for complete search history.

(56) References Cited

U.S. PATENT DOCUMENTS 3,664,001 A * 5/1972 Pilarczyk ..... 29/888.021
3,826,597 A * 7/1974 Schmitz ..... 418/131

(Continued)

FOREIGN PATENT DOCUMENTS

DE 3333035 A1 * 3/1985
DE 102004047930 A1 4/2006

(Continued)

OTHER PUBLICATIONS

Machine translation of JP 06-129392 A, which was published on May 10, 1994.*

(Continued)

*Primary Examiner* — Walter D Griffin
*Assistant Examiner* — Natasha Young
(74) *Attorney, Agent, or Firm* — GE Global Patent Operation

(57) ABSTRACT

Overhung axial compressor, chemical reactor and method for compressing a fluid. The overhung axial compressor includes a casing configured to be vertically split along a vertical axis for access to an inside of the casing and a removable cartridge. The removable cartridge is configured to fit inside the casing and to be detachably attached to the casing. The removable cartridge includes a shaft disposed along a horizontal axis, the shaft being configured to rotate about the horizontal axis, a bearing system attached to the removable cartridge and configured to rotationally support a first end of the shaft, and plural blades disposed toward a second end of the shaft such that the second end is overhung inside the casing. The compressor also includes a guide vane mechanism configured to connect to the removable cartridge, the guide vane mechanism being configured to adjust a flow of a fluid to the plural blades.

20 Claims, 12 Drawing Sheets

U.S. PATENT DOCUMENTS

| | | | | |
|---|---|---|---|---|
| 3,909,154 | A * | 9/1975 | Robb et al. | 415/110 |
| 4,057,371 | A * | 11/1977 | Pilarczyk | 417/409 |
| 5,228,832 | A * | 7/1993 | Nishida et al. | 415/208.1 |
| 6,808,374 | B2 * | 10/2004 | Phallen et al. | 418/132 |
| 2005/0132707 | A1 * | 6/2005 | Gebhardt | 60/726 |
| 2007/0172363 | A1 * | 7/2007 | Laboube et al. | 417/370 |
| 2008/0206041 | A1 | 8/2008 | Adamietz et al. | |

FOREIGN PATENT DOCUMENTS

| | | | |
|---|---|---|---|
| EP | 2312167 | A1 * | 4/2011 |
| GB | 500965 | A | 2/1939 |
| JP | 06129392 | A * | 5/1994 |
| WO | 2008045413 | A2 | 4/2008 |

OTHER PUBLICATIONS

Machine translation of DE 3333035 A1, which was published on Mar. 28, 1985.*

EP Search Report and Written Opinion dated Dec. 6, 2010 from corresponding EP Application No. 10181211.3.

* cited by examiner

OVERHUNG AXIAL FLOW COMPRESSOR, REACTOR AND METHOD

BACKGROUND

1. Technical Field

Embodiments of the subject matter disclosed herein generally relate to methods and systems and, more particularly, to mechanisms and techniques for compressing a fluid.

2. Discussion of the Background

During the past years, the demand for various chemical products has increased. One such example is the demand for polyethylene and polypropylene products, which are used, for example, in the plastics industry, the multiphase pipelines industry, etc. The manufacturing of these products has consequently also increased. One of the mechanical components used in a plant (reactor) for producing the polyethylene or polypropylene products is a centrifugal compressor.

Compressors are generally divided into positive displacement compressors and dynamic compressors. Positive displacement compressors include reciprocating and rotary compressors, which are not discussed herein. Dynamic compressors include, among others, centrifugal compressors, axial compressors and mixed-flow compressors.

An example of a centrifugal compressor is shown in FIG. 1. FIG. 1 shows the centrifugal compressor 10 having an impeller 12 connected to a shaft 14. Shaft 14 is supported by bearings 16 and 18. The impeller 12 has a hub portion 20 and a blade portion 22. A fluid enters the compressor 10 at an inlet 24, along an incoming direction A. The fluid reaches the impeller 12, where its kinetic energy is increased and its flow direction is changed prior to being discharged at outlet 26 along direction B. Because the impeller 12 is not supported on shaft 14 between bearings 16 and 18, this arrangement is called "overhung" compressor as distinct from a "between-bearings" design where the impeller(s) are supported between the bearings. In addition, because a centrifugal force produced by the impeller 12 is used to accelerate the fluid entering the compressor 10, the compressor shown in FIG. 1 is called an overhung centrifugal compressor.

The overhung centrifugal compressor is widely used in the chemical and petrochemical industry. However, a disadvantage of this compressor is its large size for a given set of processing parameters, e.g., flow parameters. For example, FIG. 2 shows a graph of a head coefficient of a compressor versus its flow coefficient. The head coefficient is related to an output pressure of the compressor and it is a dimensionless coefficient. The flow coefficient is related to a volume flow rate of the fluid through the compressor. FIG. 2 shows a variation in time of the head coefficients and flow coefficients of the existing compressors developed for the polyethylene/polypropylene industry, with the points to the left being earlier in time then the points in the right. This graph indicates that smaller head coefficients and larger flow coefficients have been required by the operators of the plants over time. Following this trend, the weight of the centrifugal compressors (especially the casing) has increased in the past ten years from an average of 20 tons to an average of 40 tons with a diameter of the impeller increasing from 45 cm to over 90 cm. By increasing the weight and size of the compressors, the weight and size of associated components, i.e., diffuser, etc., has also increased.

Another drawback of the centrifugal compressor is the fact that a, polytropic efficiency of the compressor decreases as the flow coefficient is increased beyond a certain point. Mixed flow compressors have been used for addressing the deficiencies of the centrifugal compressors as the flow coefficient become too large. However, these compressors are also reaching their limits in terms of efficiency and desirable weight and are presently suffering from the same problems as the centrifugal compressors. The mixed flow compressors are similar to the centrifugal compressors but the fluid is expelled at an angle with respect to a longitudinal axis of the compressors. In other words, the direction of the outgoing fluid is between directions A and B shown in FIG. 1, being neither axial flow (direction A) nor radial flow (direction B).

FIG. 3 shows the variation of impeller diameter (for a mixed flow compressor) versus the rotational speed (curve 30) for a given polytrophic head requirement. Also, the flow coefficient is plotted versus the impeller rotational speed (curve 32) for a given flow requirement. It is noted that for a 41-in diameter impeller (point 34) the corresponding flow coefficient is around 0.172 (point 36), which is in the generally desired range of less than approximately 0.25 for mixed-flow impellers. However, when trying to reduce the size of the impeller to around 27-in (point 38), which is approximately a 35% reduction in size, the flow coefficient goes up to 0.4, which is outside the desired range for good efficiency.

An axial compressor is illustrated in FIG. 4. The axial compressor 42 has a shaft 44 to which plural airfoils 46 are connected. A fluid enters inlet 48 and is accelerated through the plural airfoils 46, along an axial direction C, until the fluid is expelled at outlet 50. However, due to dirt particles in the fluid, deposits may be formed on the airfoils 46 and on the casing 52 of the compressor 42. For cleaning the airfoils and the casing, an upper part (not shown) of the compressor is removed for accessing the parts to be cleaned. This split of the casing 52 of the axial compressor along a horizontal plane makes this compressor a horizontal split casing axial compressor. Also, the typical axial compressor has both ends 54 of shaft 44 supported by bearings and the airfoils 46 are disposed between the bearings supporting shaft 44.

The axial compressor achieves a better flow coefficient and a smaller size impeller (airfoils) than the centrifugal and/or mixed flow compressors, and thus, a smaller weight and size. However, the drawback with the existing axial compressors is the difficulty in maintaining the axial compressor if used under dirty process gas conditions, as found in the polyethylene/polypropylene industry, as the airfoils become clogged and opening up the axial compressor and cleaning its components become time consuming and expensive.

Accordingly, it would be desirable to provide compressors, and methods that avoid the afore-described problems and drawbacks.

SUMMARY

According to one exemplary embodiment, there is an overhung axial compressor that includes a casing configured to be vertically split along a vertical axis for access to an inside of the casing and a removable cartridge. The removable cartridge is configured to fit inside the casing and to be detachably attached to the casing and includes a shaft disposed along a horizontal axis, which is substantially perpendicular to the vertical axis, the shaft being configured to rotate about the horizontal axis, a bearing system attached to the removable cartridge and configured to rotationally support a first end of the shaft, and plural blades disposed toward a second end of the shaft such that the second end is overhung inside the casing. The compressor also includes a guide vane mechanism configured to connect to the removable cartridge, the guide vane mechanism being configured to adjust a flow of a fluid to the plural blades.

According to another exemplary embodiment, there is a chemical reactor for handling a chemical substance. The chemical reactor includes a first pipe providing the chemical substance under pressure; a compressor having an inlet connected to the first pipe and configured to compress the chemical substance; and a second pipe connected to an outlet of the compressor and configured to receive the compressed chemical substance. The compressor includes a casing configured to be vertically split along a vertical axis for access to an inside of the casing, a removable cartridge configured to fit inside the casing and to be detachably attached to the casing, the removable cartridge including, a shaft disposed along a horizontal axis, which is substantially perpendicular to the vertical axis, the shaft being configured to rotate about the horizontal axis. The compressor also includes a bearing system attached to the removable cartridge and configured to rotationally support a first end of the shaft, and plural blades disposed toward a second end of the shaft such that the second end is overhung inside the casing. The compressor also includes a guide vane mechanism configured to connect to the removable cartridge, the guide vane mechanism being configured to adjust a flow of a fluid to the plural blades.

According to still another exemplary embodiment, there is a method for making an overhung axial compressor. The method includes inserting a removable cartridge into a casing, which is configured to be vertically split along a vertical axis for access to an inside of the casing. The removable cartridge includes, a shaft disposed along a horizontal axis, which is substantially perpendicular to the vertical axis, the shaft being configured to rotate about the horizontal axis, a bearing system attached to the removable cartridge and configured to rotationally support a first end of the shaft, and plural blades disposed toward a second end of the shaft such that the second end is overhung inside the casing. The method also includes connecting a guide vane mechanism to the removable cartridge, the guide vane mechanism being configured to adjust a flow of a fluid to the plural blades.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a radial inlet and an axial outlet overhung axial compressor. However, the embodiments to be discussed next are not limited to these systems, but may be applied to other systems, as for example an overhung axial compressor having an axial inlet and a radial outlet.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, an overhung axial compressor that has a vertical split casing is used for achieving a smaller weight and size for a desired high flow coefficient (greater than approximately 0.2) and low polytropic head applications.

Figure 6:
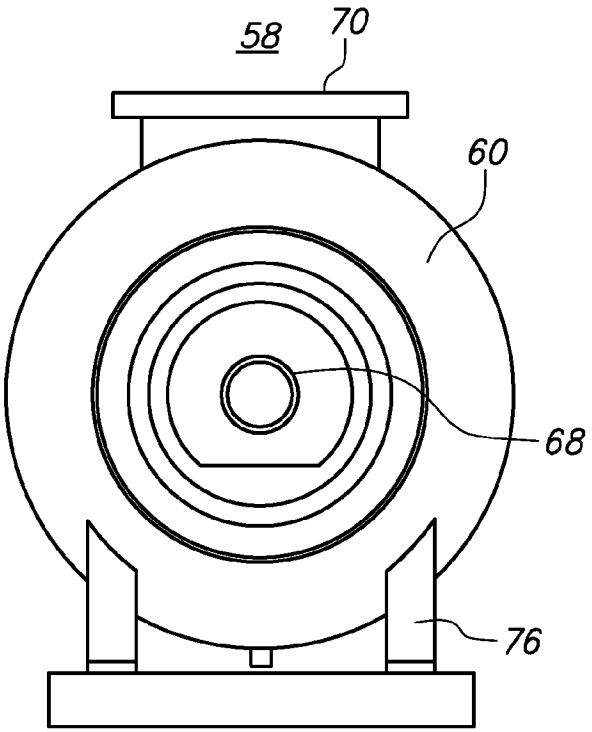
FIGS. 5 and 6 are different views of an overhung axial compressor according to an exemplary embodiment.
Figure 5:
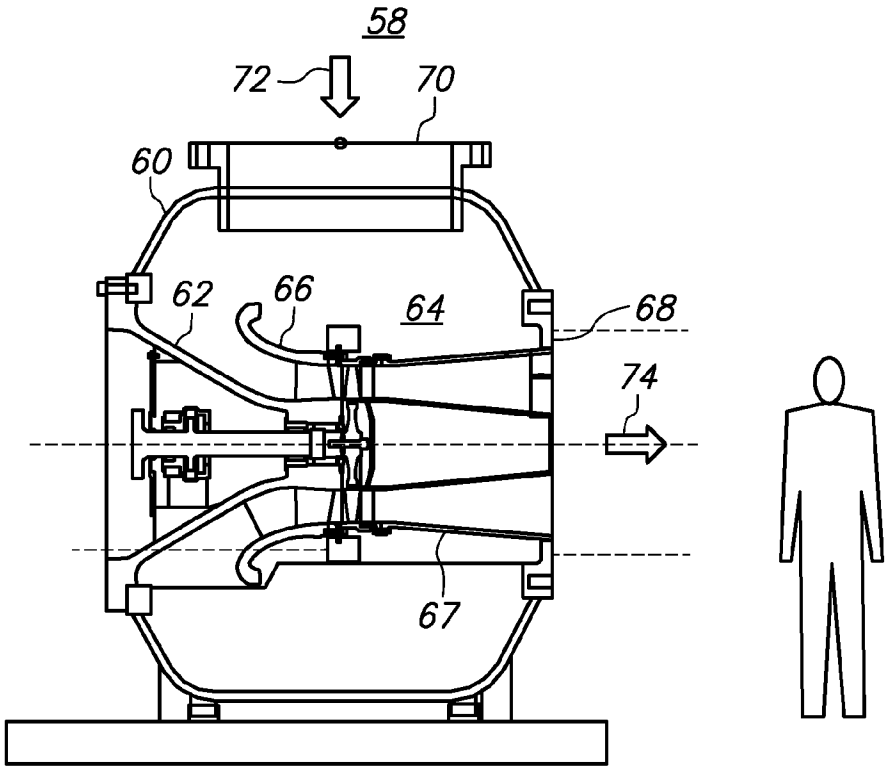

According to an exemplary embodiment shown in FIG. 5, an overhung axial compressor 58 includes a casing 60 and a removable cartridge 62. The casing 60 has an inside 64 to which the cartridge 62 is removably attached. The compressor 58 also includes a guide vane mechanism 66 that is connected to a diffuser 67, which is connected to an outlet 68 of the compressor 58. The compressor 58 has an inlet 70 that leads a fluid to the removable cartridge 62 along a vertical axis 72. The fluid enters a passage (120 shown in FIG. 11) and its direction is controlled using the guide vane 66. The fluid is then compressed by the rotating blades (90 shown in FIG. 9) immediately after the guide vanes. FIG. 6 shows the compressor 58 as viewed along the horizontal axis 74, from the outlet 68. The compressor 58 may be supported by legs 76.

Figure 7:
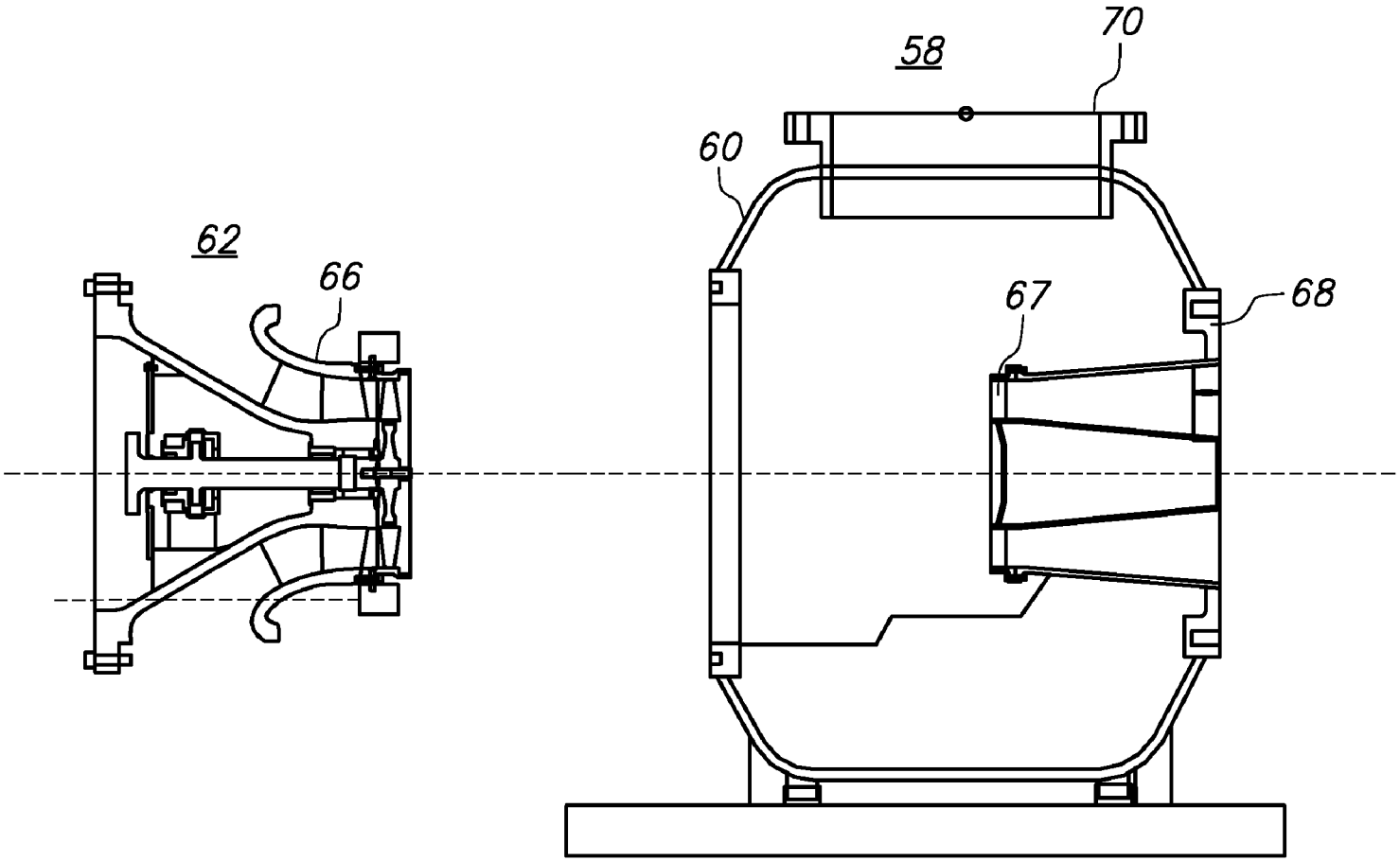
FIG. 7 is a cross sectional view of an overhung axial compressor according to an exemplary embodiment.
Figure 8:
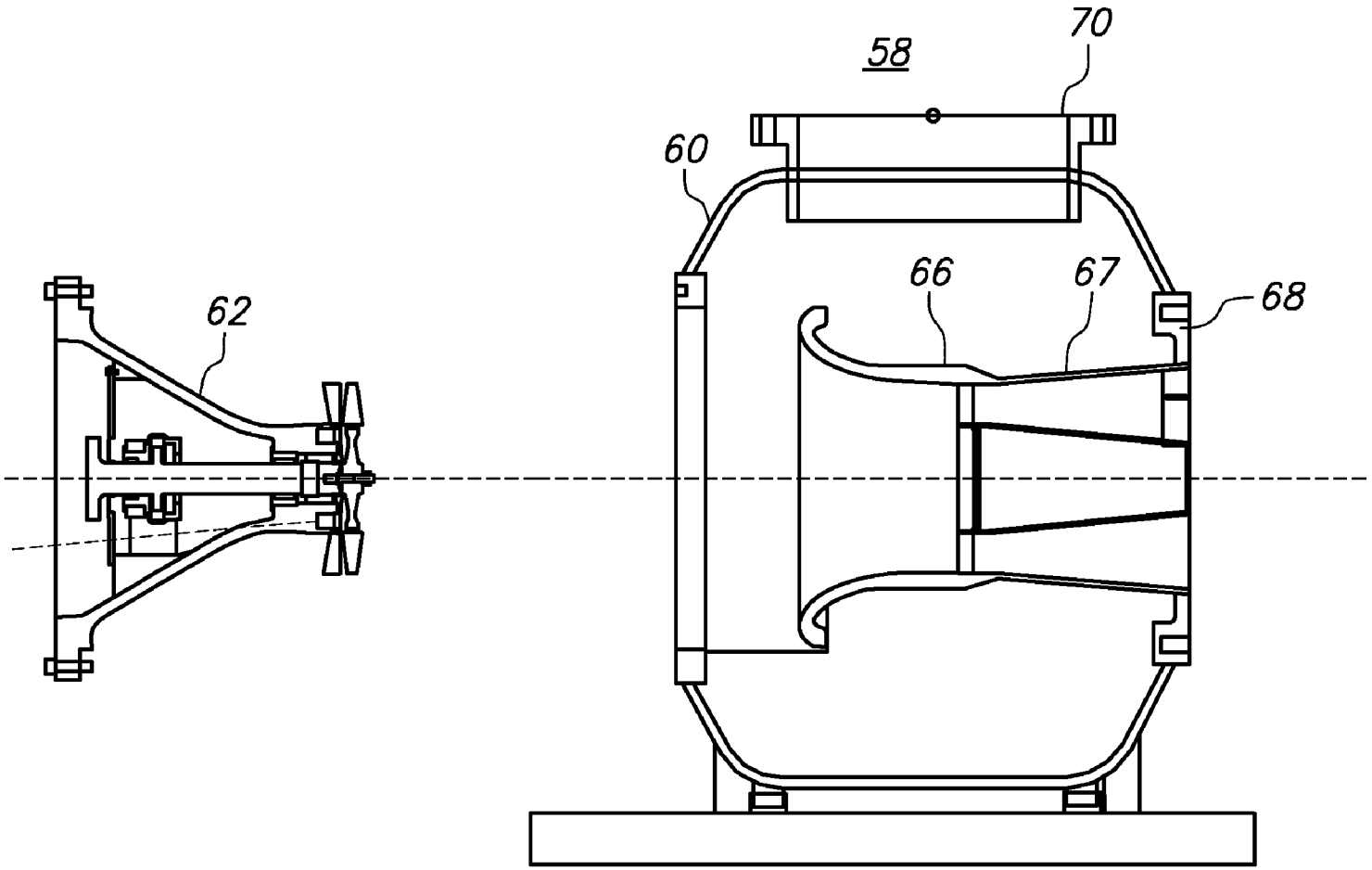
FIG. 8 is a cross sectional view of an overhung axial compressor according to another exemplary embodiment.

FIG. 7 shows the removable cartridge 62 removed in its entirety from the casing 60. In the embodiment of FIG. 7, the cartridge 62 includes the guide vane mechanism 66. However, according to another exemplary embodiment shown in FIG. 8, the cartridge 62 may not include the guide vane mechanism 66. In the embodiment of FIG. 8, the guide vane mechanism 66 stays connected to diffuser 67, thus making the cartridge 62 lighter as the guide vane mechanism 66 may weight around 2 tons.

Figure 1:
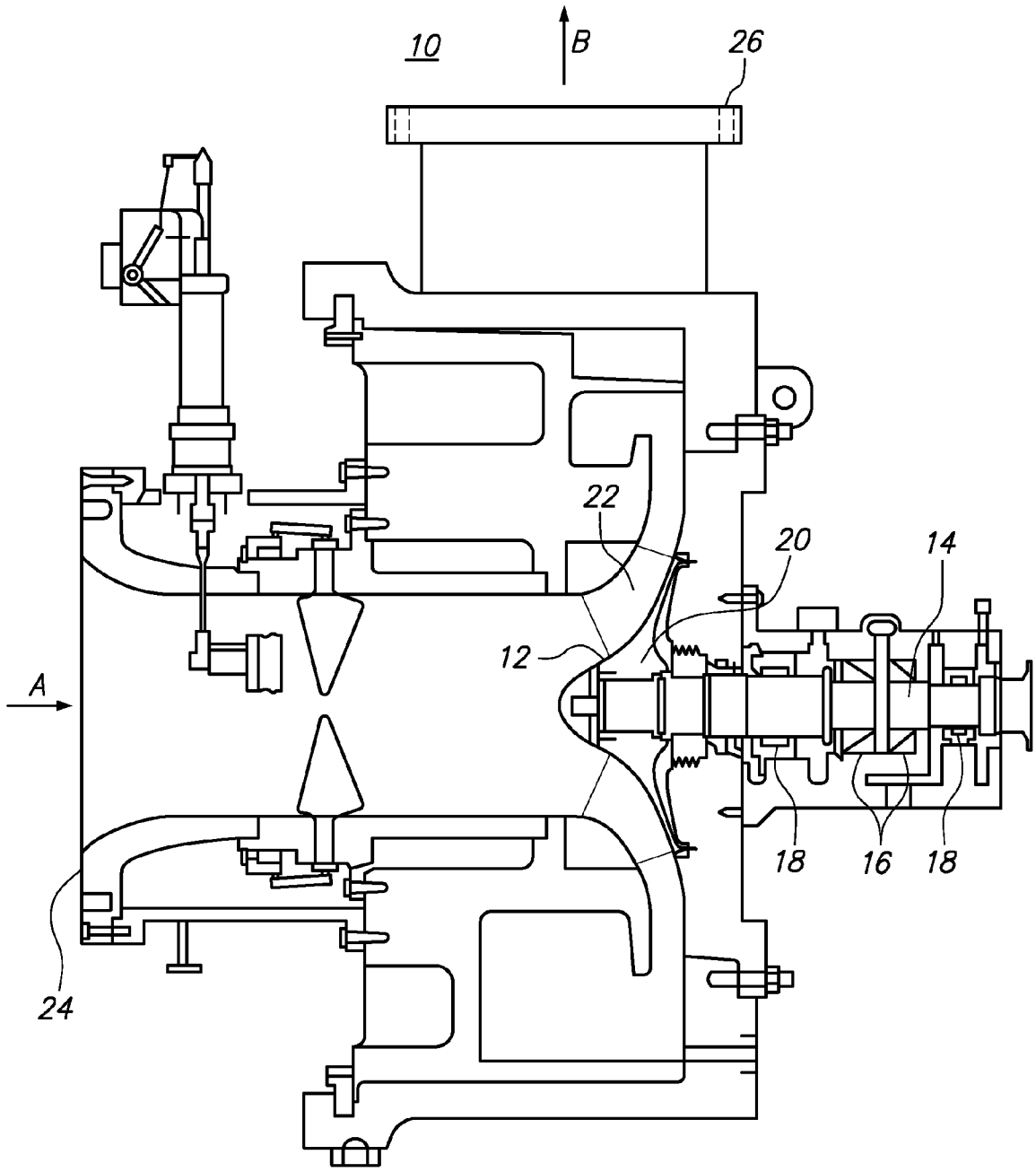
FIG. 1 (Background Art)
FIG. 1 is a schematic diagram of a conventional centrifugal compressor with mixed flow impeller.
Figure 2:
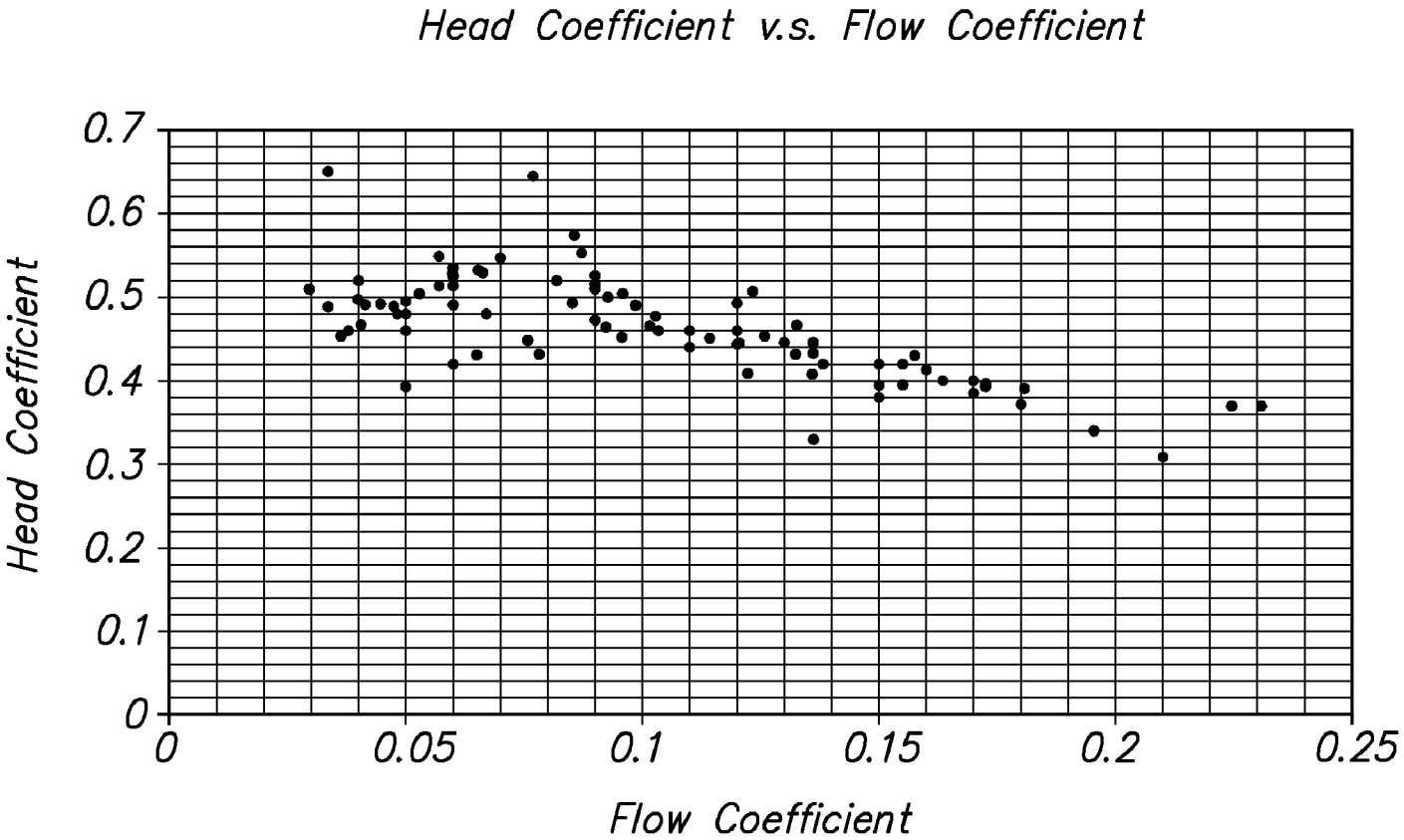
FIG. 2 (Background Art)
FIG. 2 is a graph showing the variations of head coefficient as a function of flow coefficient for a compressor in the polyethylene/polypropylene industry.
Figure 3:
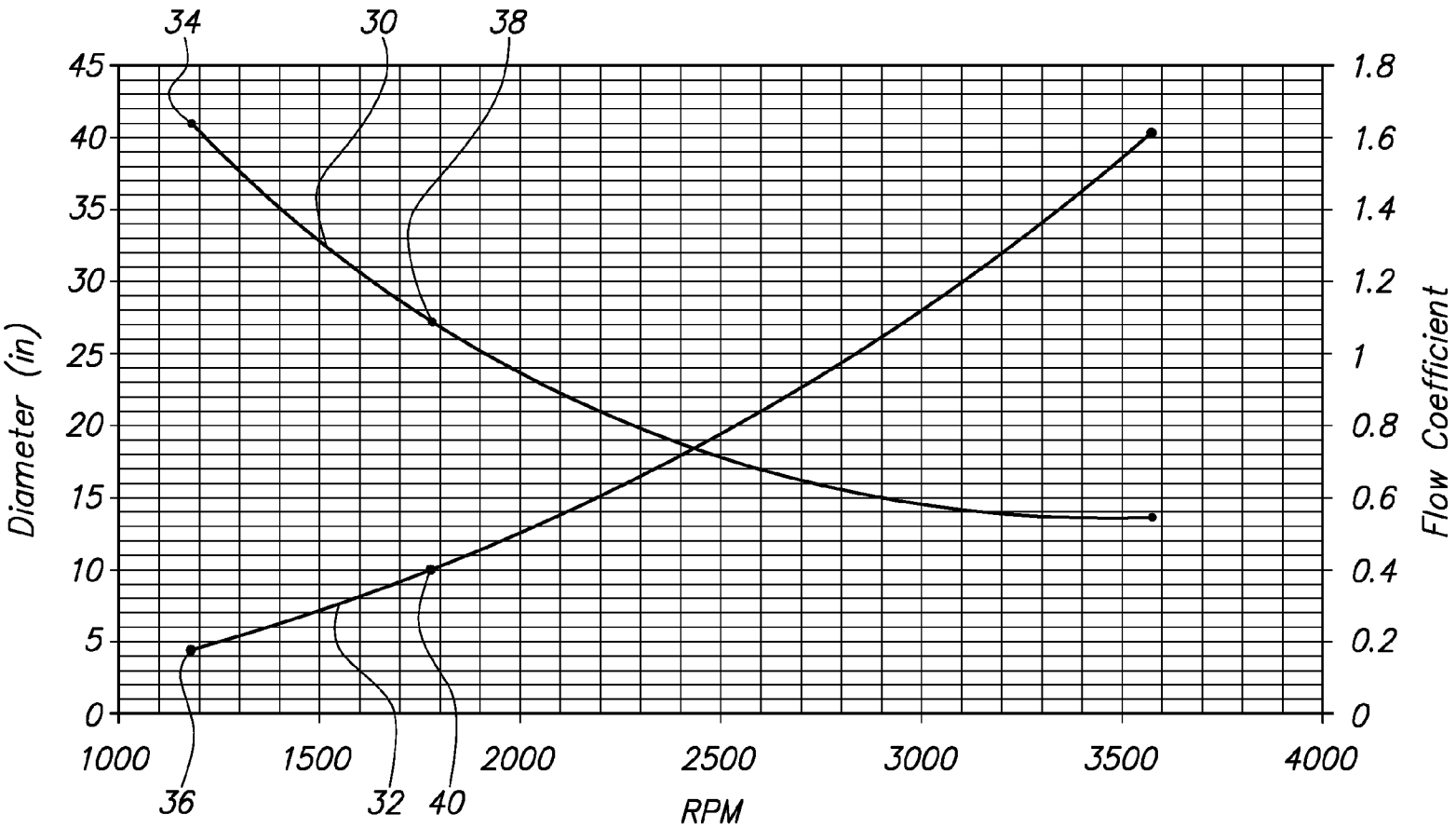
FIG. 3 (Background Art)
FIG. 3 is a graph showing a relation between a diameter of an impeller of a compressor and a speed of the impeller for a compressor for a given polytropic head and flow.
Figure 4:
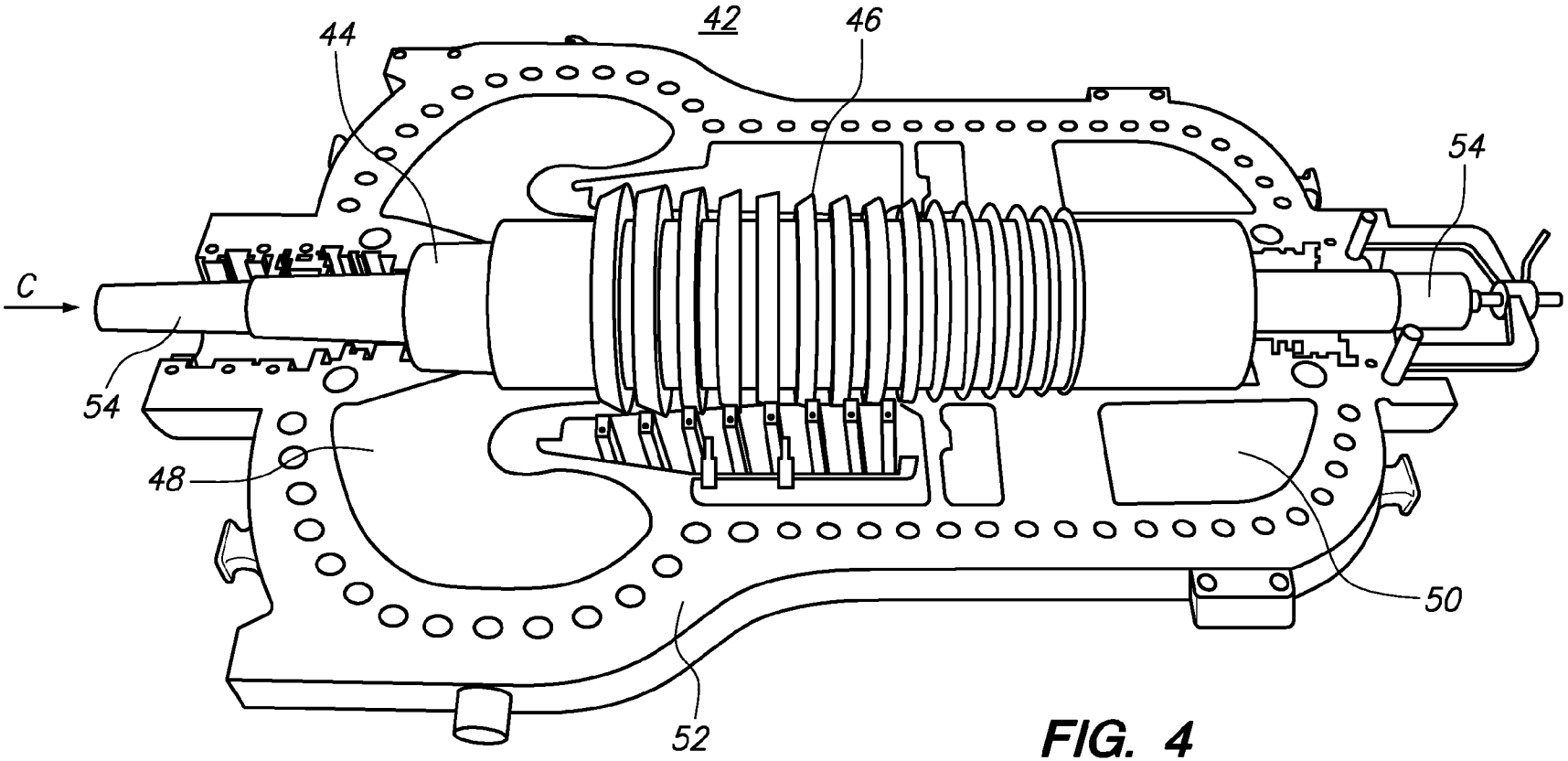
FIG. 4 (Background Art)
FIG. 4 is a schematic diagram of a conventional axial compressor.
Figure 9:
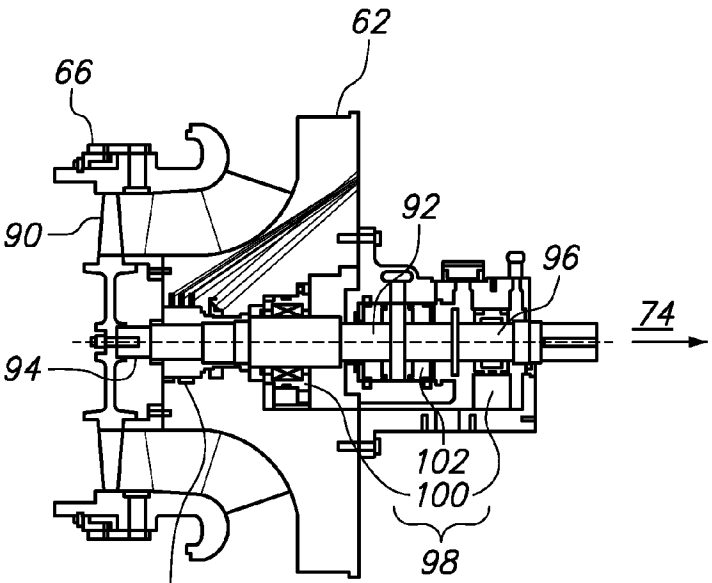
FIGS. 9 and 10 are cross sectional views of various components of an overhung axial compressor according to still another exemplary embodiment.

According to another exemplary embodiment, FIG. 9 shows the cartridge 62 removed from the casing 60 of the compressor 58. The cartridge 62 may include one or more blades 90 connected to a shaft 92, which is configured to rotate about the horizontal axis 74. The blade 90 may include the plural airfoils 46 shown in FIG. 4 and the blade 90 is disposed at a first end 94 of the shaft 92. The blade 90 may be a blisk. The shaft 92 is supported at a second end 96 by a bearing system 98. Thus, the axial compressor shown in FIG. 9 is an overhung axial compressor, as the blade 90 hangs at the first end 94 of the shaft 92, separate from the bearing system 98, which is different from the conventional axial compressors in which the blade is disposed between bearings of the bearing system. The bearing system 98 may include tilt pad bearings 100 and other bearings 102. The cartridge 62 may include a dry gas seal 104 that is configured to prevent the fluid entering at inlet 70 to escape to the atmosphere. Thus, according to this exemplary embodiment, all the moving parts of the compressor are included in the cartridge 62, which makes easier the process of servicing the compressor.

Figure 10:
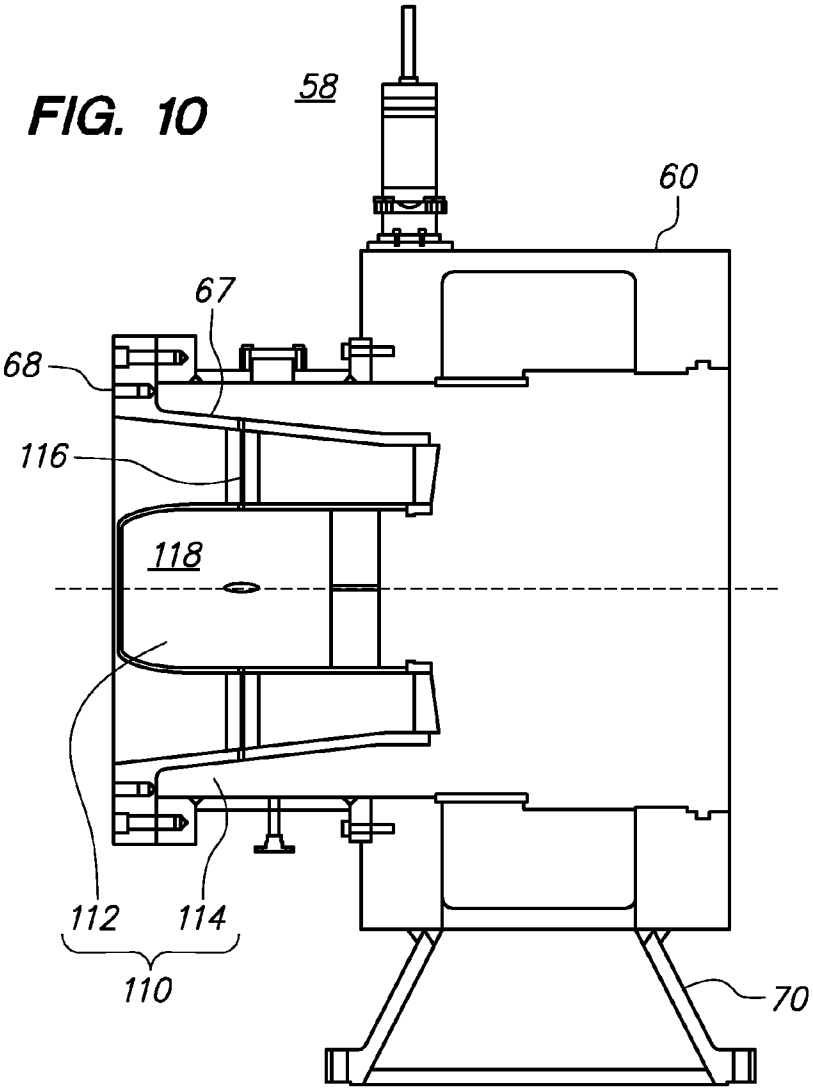

FIG. 10 shows a casing 60 configured to receive the cartridge 62 shown in FIG. 9. According to this exemplary embodiment, the casing 60 includes a buffer system 110. The buffer system 110 may include a first buffer cavity 112 and a second buffer cavity 114. The first buffer cavity 112 is provided in a central portion of the outlet 68, radially aligned with the shaft 92. A conduit 116 connects an inside region 118 of the first buffer cavity 112 to a clean gas supply (not shown) for providing a clean gas inside the first buffer cavity 112. A pressure of the clean gas inside the first buffer cavity 112 is controlled to be higher than a pressure of the fluid expelled by the blade 90, such that the dirty fluid compressed by the blade 90 does not enter the first buffer cavity 112. A buffer gas provides a higher pressure in the various cavities and therefore prevents the process gas with its particles from entering and building up inside the cavity or space. The second buffer cavity 114 ensures that the guide vane mechanism is kept free of build up, which may interfere with its operation.

Figure 11:
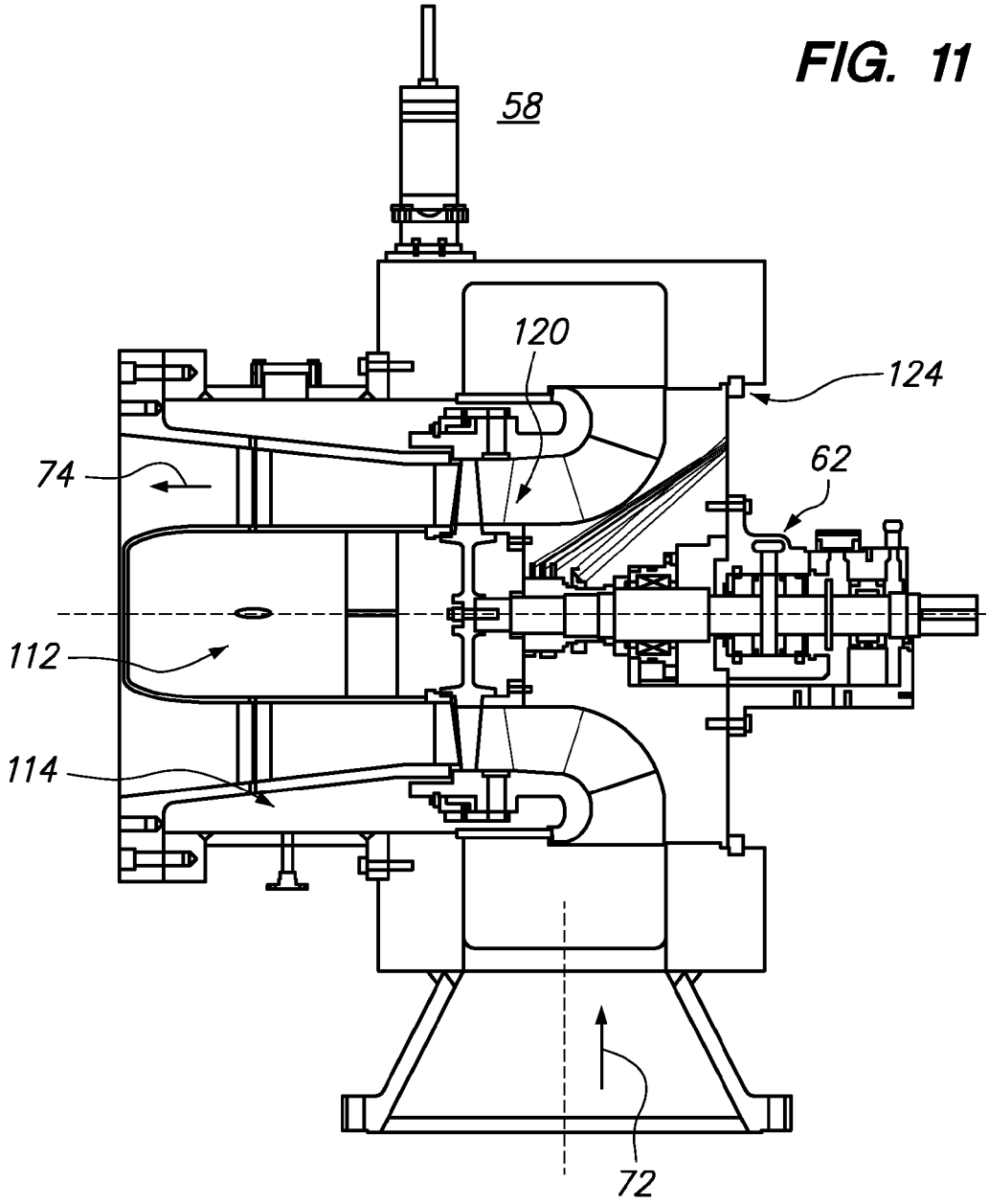
FIG. 11 is a cross sectional view of the assembled overhung axial compressor shown in FIGS. 9 and 10.
Figure 12:
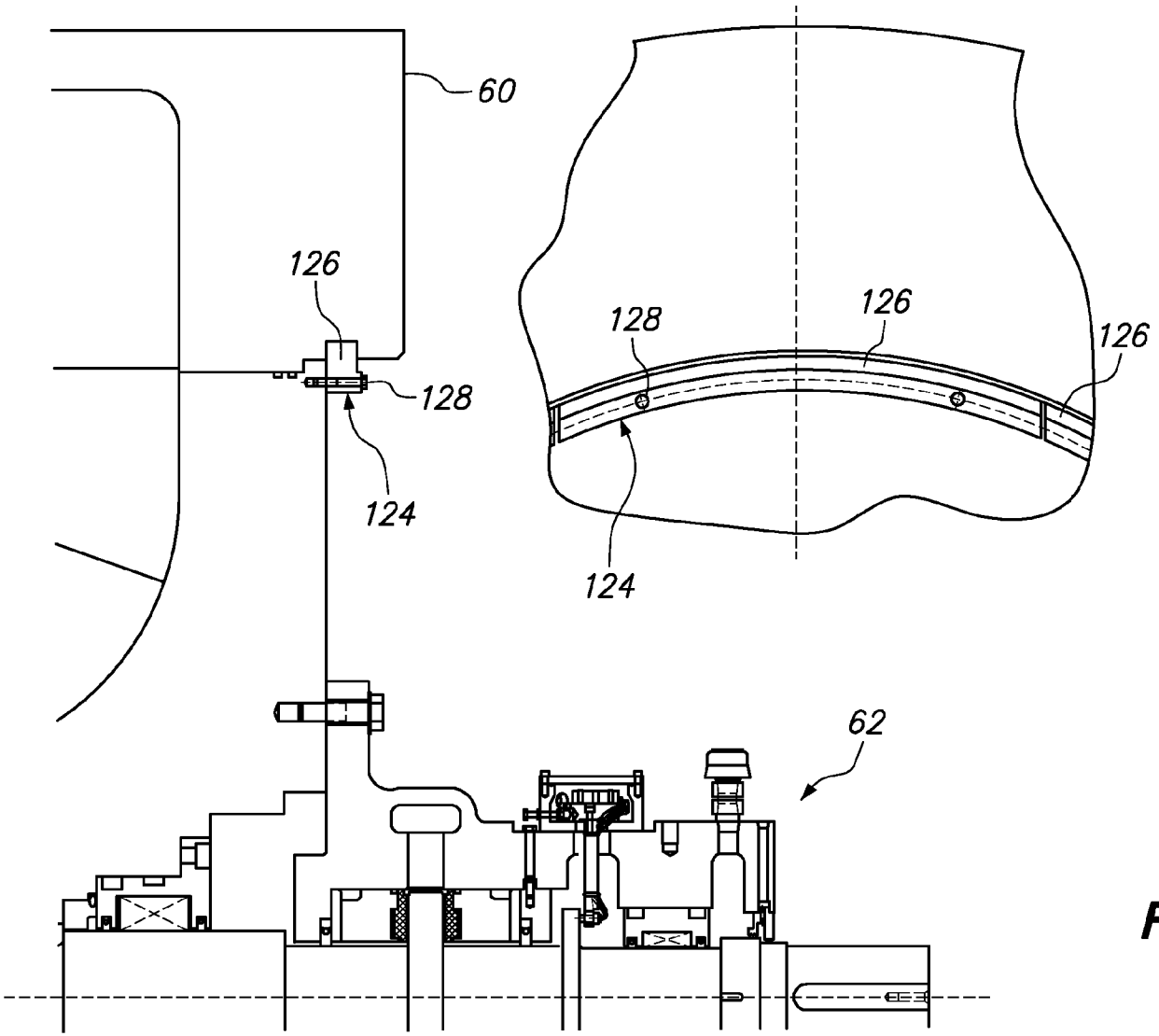
FIG. 12 is a schematic diagram of a shear ring interface according to an exemplary embodiment.

FIG. 11 shows the cartridge 62 of FIG. 9 attached to the casing 60 of the compressor 58 of FIG. 10 and the incoming direction 72 of the fluid to be compressed and the outgoing direction 74 of the compressed fluid. It is noted that a path 120 of the flowing fluid is mostly free of cavities, which are one factor that determine product buildup on the components of the compressor. However, any locations where the process gas could infiltrate into spaces such as 112 and 114 are buffered with clean gas to prevent build up in such areas. Thus, by using these features in the novel overhung axial compressor according to one or more embodiments, the product buildup is reduced or eliminated. Further, the compressor 58 shown in FIG. 11 provides straight access to the moving parts as the cartridge 62 may be easily removed from the casing 60 of the compressor. A shear ring interface 124 connects the removable cartridge 62 to the casing 60. The shear ring interface 124 is shown in more details in FIG. 12. FIG. 12 shows the shear ring interface 124 having a segmented design, i.e., plural segments 126 that can be attached with screws 128 to the casing 60 of the compressor 58. In this way, the shear ring interface 124 allows a simple removal of the removable cartridge 62. In one exemplary embodiment, the shear ring interface 124 is the only element that holds the removable cartridge 62 attached to the casing 60 (a connecting rod (not shown) connecting the guide vane mechanism to an actuator is not considered as holding the removable cartridge 62 attached to the casing 60).

It is noted that a traditional horizontally split axial compressor is difficult to maintain and service due to numerous pocket areas that are inherent in its design. The novel overhung, vertically split, axial compressor discussed with regard to FIGS. 5-12 avoids these disadvantages of the traditional axial compressors by reducing the cavities along the fluid path. Also, the novel overhung axial compressor, according to one or more exemplary embodiments, achieves a better flow path and potential for improved performance and a smaller weight than the mixed flow and centrifugal compressors.

Further, the novel overhung axial compressor, according to one or more exemplary embodiments, provides a radial inlet/axial discharge for simplified reactor piping connection, as the novel compressor needs to be connected to various pipes of a reactor. Furthermore, the modular assembly of the cartridge to the casing of the compressor eliminates the need for pipe removal that is present in the conventional compressors.

As this novel overhung axial compressor may be used in a chemical reactor for providing the required chemical components at a certain pressure, various chemical compounds may be circulated through the compressor, as for example, ethylene oxide, ethylene glycol, natural gas, C3 splitter, polyethylene, polypropylene, etc. In an exemplary embodiment, one or more novel overhung axial compressors may be used for the desired fluid and/or the cycle gas compression process. The novel overhung axial compressor, due to its design, achieves a relatively small head rise. However, the cycle gas compression process in a chemical reactor requires high input pressures and low pressure rise compressors. Because of the input high pressure, the novel compressor is configured to have a high pressure casing to handle the high inlet and discharge pressures.

Figure 13:
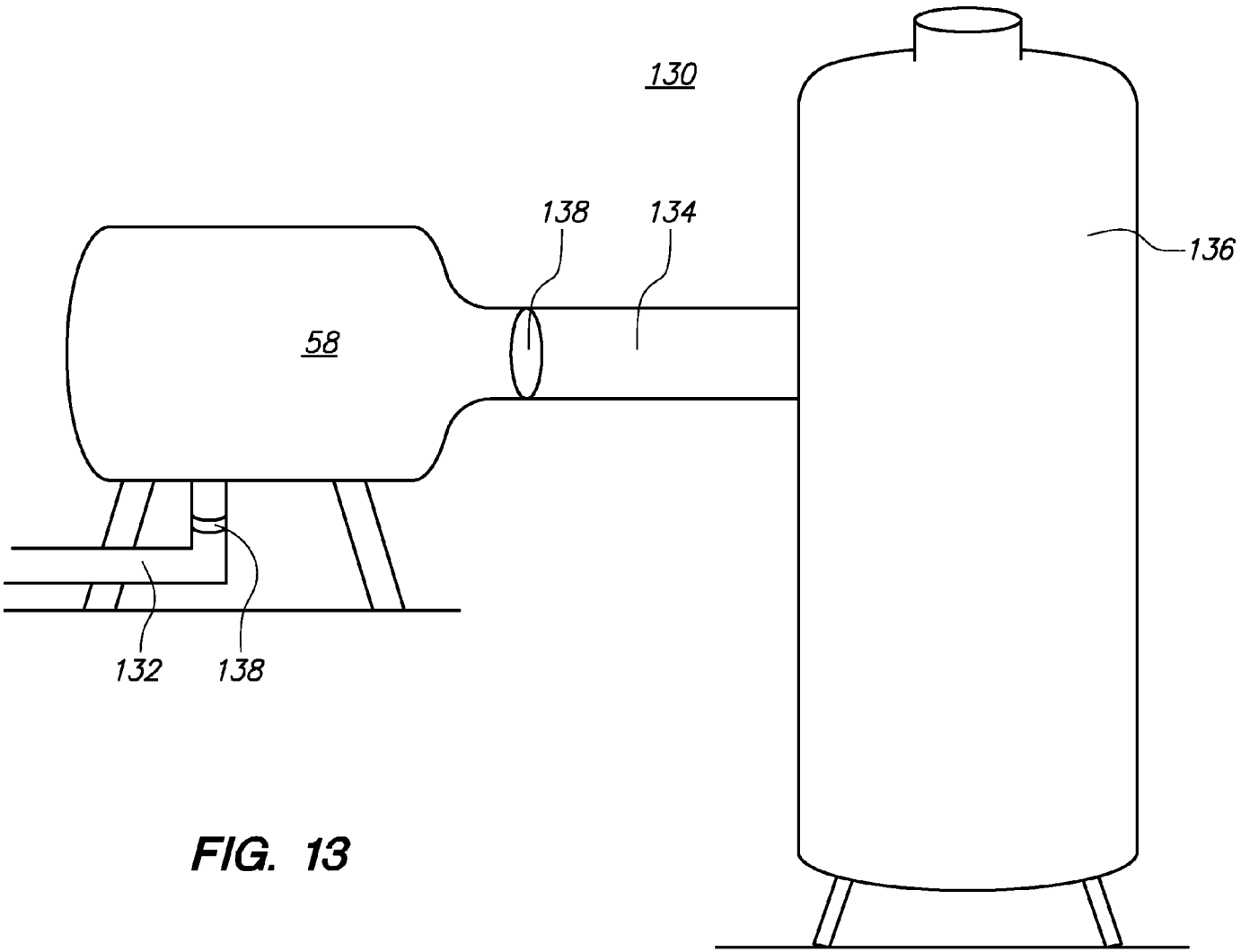
FIG. 13 is a schematic diagram of a chemical reactor that includes an overhung axial compressor according to an exemplary embodiment.

According to an exemplary embodiment, illustrated in FIG. 13, a chemical reactor 130 includes at least a first pipe 132 that provides a chemical substance to a compressor, which may be the novel overhung axial compressor 58 discussed in the previous embodiments. After the compressor 58 compresses the chemical substance, it outputs the compressed chemical substance to a second pipe 134, which supplies the compressed chemical substance to the reaction tank 136. Connecting interfaces 138 ensure a tight connection between the compressor 58 and the first and second pipes 132 and 134.

Figure 14:
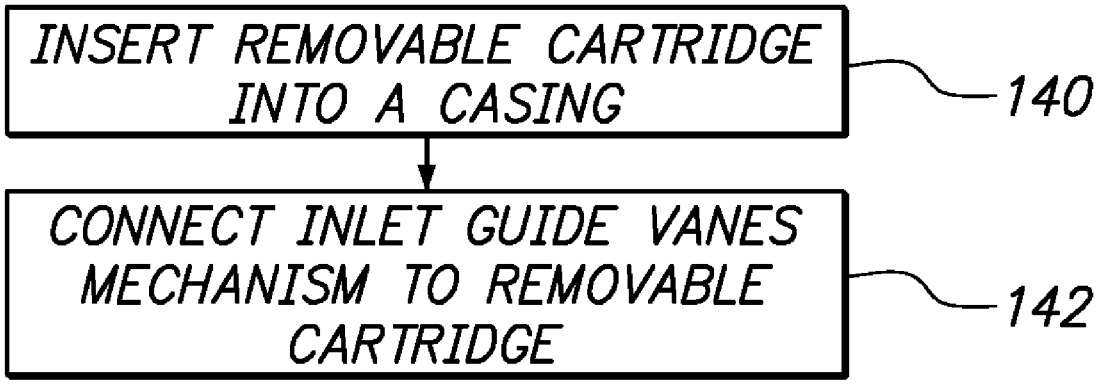
FIG. 14 is a flow chart illustrating steps of a method for making an overhung axial compressor according to an exemplary embodiment.

A method for making the overhung axial compressor 58 is now discussed with regard to FIG. 14. According to this exemplary embodiment, the method includes a step 140 of inserting a removable cartridge into a casing, which is configured to be vertically split along a vertical axis for access to an inside of the casing. The removable cartridge includes, a shaft disposed along a horizontal axis, which is substantially perpendicular to the vertical axis, the shaft being configured to rotate about the horizontal axis, a bearing system attached to the removable cartridge and configured to rotationally support a first end of the shaft, and plural blades disposed toward a second end of the shaft such that the second end is overhung inside the casing. The method also includes a step 142 of connecting a guide vane mechanism to the removable cartridge, the guide vane mechanism being configured to adjust a flow of a fluid to the plural blades.

Optionally, the method may include a step of fixing the guide vane mechanism to the casing when the removable cartridge is inserted into the casing (i.e., the guide vane mechanism may not be part of the removable cartridge) or a step of fixing the guide vane mechanism to the removable cartridge when the removable cartridge is inserted into the casing (i.e., the guide vane mechanism is part of the removable cartridge). Further, the method may include connecting the removable cartridge to the casing with a shear ring interface, which is the only connection between the removable cartridge and the casing and/or attaching a buffering system to the casing, the buffering system being configured to receive an outgoing fluid from the removable cartridge.

The disclosed exemplary embodiments provide an overhung axial compressor, a chemical reactor, and a method for compressing a fluid. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements within the literal languages of the claims.

What is claimed is:

1. An overhung axial compressor comprising:

a casing configured to be vertically split along a vertical axis for access to an inside of the casing;

a removable cartridge configured to fit inside the casing and to be detachably attached to the casing, the removable cartridge including, a shaft disposed along a horizontal axis, which is substantially perpendicular to the vertical axis, the shaft being configured to rotate about the horizontal axis, a bearing system attached to the removable cartridge and configured to rotationally support a first end of the shaft, and plural blades disposed toward a second end of the shaft such that the second end is overhung inside the casing; and a guide vane mechanism configured to connect to the removable cartridge, the guide vane mechanism being configured to adjust a flow of a fluid to the plural blades.

2. The overhung axial compressor of claim 1, wherein the guide vane mechanism is fixed to the casing when the removable cartridge is removed from the casing.

3. The overhung axial compressor of claim 1, wherein the guide vane mechanism is fixed to the removable cartridge and is removable together with the removable cartridge.

4. The overhung axial compressor of claim 1, further comprising:

an inlet connected to the casing and configured to lead an incoming fluid to the plural blades along the vertical axis.

5. The overhung axial compressor of claim 4, further comprising:

an outlet connected to the casing and configured to lead an outgoing fluid along the horizontal axis.

6. The overhung axial compressor of claim 1, further comprising:

a shear ring interface that connects the removable cartridge to the casing and is the only connection between the removable cartridge and the casing that holds the removable cartridge attached to the casing.

7. The overhung axial compressor of claim 1, further comprising:

a buffering system provided in the casing, the buffering system being attached to the casing and being configured to provide a clean buffer gas to predetermined areas that are to be devoid of particle build up.

8. The overhung axial compressor of claim 7, wherein the buffering system comprises:

a first buffer cavity configured to receive a clean fluid at a pressure higher than the outgoing fluid to prevent a process fluid from entering, the first buffer cavity, wherein the first buffer cavity is disposed along the horizontal axis and is radially aligned with the shaft.

9. The overhung, axial compressor of claim 8, wherein the buffering system further comprises:

a second buffer cavity disposed along an internal circumference of the casing around the first buffer cavity.

10. A chemical reactor for handling a chemical substance, the chemical reactor comprising:

a first pipe providing the chemical substance under pressure;

a compressor having an inlet connected to the first pipe and configured to compress the chemical substance; and a second pipe connected to an outlet of the compressor and configured to receive the compressed chemical substance, wherein the compressor includes, a casing configured to be vertically split along a vertical axis for access to an inside of the casing, a removable cartridge configured to fit inside the casing and to be detachable attached to the casing, the removable cartridge including, a shaft disposed along a horizontal axis, which is substantially perpendicular to the vertical axis, the shaft being configured to rotate about the horizontal axis, a bearing system attached to the removable cartridge and configured to rotationally support a first end of the shaft, and plural blades disposed toward a second end of the shaft such that the second end is overhung inside the casing; and a guide vane mechanism configured to connect to the removable cartridge, the guide vane mechanism being configured to adjust a flow of a fluid to the plural blades.

11. The reactor of claim 10, wherein the guide vane mechanism is fixed to the casing when the removable cartridge is removed from the casing.

12. The reactor of claim 10, wherein the guide vane mechanism is fixed to the removable cartridge and is removable together with the removable cartridge.

13. The reactor of claim 10, further comprising:

a shear ring interface that connects the removable cartridge to the casing and is the only connection between the removable cartridge and the casing that holds the removable cartridge attached to the casing.

14. The reactor of claim 10, further comprising:

a buffering system provided in the casing, the buffering system being attached to the casing and being configured to receive a process fluid from the removable cartridge.

15. The reactor of claim 10, wherein the chemical substance is one of ethylene oxide, ethylene glycol, natural gas, C3 splitter, polyethylene, polypropylene.

16. A method for making an overhung axial compressor, the method comprising:

inserting a removable cartridge into a casing, which is configured to be vertically split along a vertical, axis for access to an inside of the casing, wherein the removable cartridge includes, a shaft disposed along a horizontal axis, which is substantially perpendicular to the vertical axis, the shaft being configured to rotate about the horizontal axis, a bearing system attached to the removable cartridge and configured to rotationally support a first end of the shaft, and plural blades disposed toward a second end of the shaft such that the second end is overhung inside the casing; and connecting a guide vane mechanism to the removable cartridge, the guide vane mechanism being, configured to adjust a flow of a fluid to the plural blades.

17. The method of claim 16, wherein the guide vane mechanism is fixed to the casing when the removable cartridge is inserted into the casing.

18. The method of claim 16, wherein the guide vane mechanism is fixed to the removable cartridge when the removable cartridge is inserted into the casing.

19. The method of claim 16, further comprising:

connecting the removable cartridge to the casing with a shear ring interface, which is the only connection between the removable cartridge and the casing that holds the removable cartridge attached to the casing.

20. The method of claim 16, further comprising:

attaching a buffering system to the casing, the buffering system being configured to receive a process fluid from the removable cartridge.

* * * * *